US006591525B1

(12) United States Patent
Liu

(10) Patent No.: US 6,591,525 B1
(45) Date of Patent: Jul. 15, 2003

(54) FIXED SUPPORTED STRUCTURE OF CRYSTAL BALL TRANSMISSION

(76) Inventor: Jack Liu, 3F., 200, Sin-Yi Rd., Sec. 3, Taipei (TW)

( * ) Notice: Subject to any disclaimer, the term of this patent is extended or adjusted under 35 U.S.C. 154(b) by 0 days.

(21) Appl. No.: 10/212,684

(22) Filed: Aug. 7, 2002

(51) Int. Cl.[7] ..... G09F 19/00
(52) U.S. Cl. ..... 40/410; 40/414
(58) Field of Search ..... 40/409, 410, 406, 40/411, 414; 446/267

(56) References Cited

U.S. PATENT DOCUMENTS 5,864,976 A * 2/1999 Yang ..... 40/410
5,875,577 A * 3/1999 Lu ..... 40/411
5,967,088 A * 10/1999 Lin ..... 40/406
6,036,571 A * 3/2000 Chang ..... 40/410
6,241,255 B1 * 6/2001 Fang ..... 40/410

* cited by examiner

*Primary Examiner*—Gary Hoge
(74) *Attorney, Agent, or Firm*—Dennison, Schultz & Dougherty

(57) ABSTRACT

The invention relates to a fixed supporting structure of a crystal ball transmission, comprising a crystal ball, a base, a soft rubber sealed-spigot, a fixed seat and a driven motor, a magnet set, disturbing vane and a fixed disc of decoration and so on installed on above rubber sealed-spigot and fixed seat; characterized in that the rubber sealed-spigot is designed to have a circular sealed-spigot body for sealing the crystal ball opening and a disk-shaped elastic buffer body, wherein, the buffer body further comprises an upper section planar disc edge, a middle section inclined disc edge and a lower section planar disc bottom; and by means of pushing upward a cup-shaped supporting body of the fixed seat and stopping at the buffer body so as to form selected point supporting; when heat expansion and cold contraction are happened due to temperature difference of liquid within the crystal ball, the middle section inclined disc edge of the buffer body will stretch elastically and automatically to absorb the change of volume, by using the upward supporting force of the cup-shaped supporting body under the buffer body to ensure the horizontal position of the fixed disc of decoration unchanged, so as to further ensure the decoration does not incline for buffer body deformation due to the change of liquid volume and to maintain the flowing out-in passage of suspended substance being smooth.

1 Claim, 5 Drawing Sheets

FIXED SUPPORTED STRUCTURE OF CRYSTAL BALL TRANSMISSION

FIELD OF INVENTION

The invention relates generally to a fixed supporting structure of a crystal ball transmission, comprising a crystal ball, a base, a soft rubber sealed-spigot, a fixed seat and a driven motor, a magnet set, disturbing vane and a fixed disc of decoration and so on installed on above rubber sealed-spigot and fixed seat; characterized in that the rubber sealed-spigot is designed to have a circular sealed-spigot body and a disk-shaped elastic buffer body for sealing the crystal ball opening, wherein, the buffer body further comprises an upper section planar disc edge, a middle section inclined disc edge and a lower section planar disc bottom; and by means of pushing upward the cup-shaped supporting body of the fixed seat and stopping at the buffer body so as to form selected point supporting; when heat expansion and cold contraction are happened due to temperature difference of liquid within the crystal ball, the middle section inclined disc edge of the buffer body will stretch elastically and automatically to absorb the change of volume, by using the upward supporting force of the cup-shaped supporting body under the buffer body to ensure the horizontal position of the fixed disc of decoration unchanged, so as to further ensure the decoration could not incline for buffer body deformation due to the change of liquid volume and to maintain flowing out-in passage of suspended substance being smooth.

BACKGROUND OF INVENTION

A crystal ball is put on the table or cabinet of home or office as a decoration. Since the ball is filled with liquid, the magnifying effect of convex lens is formed, making the various models in the crystal ball, such as trees, houses, castles, figures and so on be glittering and translucent particularly. If shining slice is put into the crystal ball additionally, the shining slice will create a hypothetical scenery as snow failing down by falling from up-side to low-side slowly while the crystal ball is put back after being shaken up and down. By this way, the crystal ball appears very elegant dynamic scenery.

The above hypothetical snow-falling-down scenery created by shaking the crystal ball manually will tend to rest as suspended substance precipitating gradually. In order to make the hypothetical snow-falling-down scenery being continuous without interruption, U.S. Pat. No. 4,961,276 has disclosed that by using the power of battery to rotate a motor, a magnet installed on the output shaft of the motor will bring another opposite magnet and rotating vane to rotate under the effect of magnetic flux, so as to achieve the goal of disturbing liquid continuously. In addition, U.S. Pat. No. 4,641,445 has disclosed that by using the power of battery to rotate a motor, the rotating vane directly installed on the free end of the output shaft of the motor rotates, so as to achieve the goal of disturbing suspended substance continuously for creating the hypothetical snow-falling-down scenery.

See FIG. 1, an appearance perspective view of U.S. Pat. No. 4,967,276. The motor and the first magnet are installed in the tube-shaped shell under the top plane of the sealed-spigot; the second magnet and the rotating vane are installed above the top plane of the sealed-spigot. When the volume of liquid filled in the crystal ball creates expansion or contraction due to temperature difference (such as 20° C.–40° C.) of the room, the top plane of the sealed-spigot will bend downward as heat-expansion and cold-contraction of the liquid, and the decoration installed on the top plane of the sealed-spigot appears irregular inclination as the bending of the top plane. It has a serious effect on the total beauty. Also, the rotating vane in the figure lies out of the top plane of the sealed-spigot; therefore, the decoration could not be put in the central position of the crystal ball. It is no doubt that the design of the rotating vane will be limited. In addition, the rotating vane exposed outside is not propitious to the total beauty.

See FIG. 2. The skilled in art would install a fixed disc B of decoration above the rotating vane A to cover the rotating vane A exposed outside and in the meantime to overcome the defect that is the decoration could not be put into the central position. However, in order to avoid the rotating vane A from the effect of the fixed disc B of decoration and to enable the suspended substance to flow smoothly after being disturbed, a certain distance Y must be kept between the fixed disc of decoration and the rotating vane. Thus, the distance between the fixed disc B of decoration and the top plane D of the sealed-spigot is increased, and the rotating vane A could not be covered certainly. Similarly, it is a pity from the beauty point of view. In order to solve this problem, the diameter of the fixed disc B of decoration is usually increased as big as possible to match the top plane D of the sealed-spigot. The bigger fixed disc B of decoration covers the rotating vane.

Also see FIG. 3. When the volume of liquid expands due to temperature increasing, the top plane D of the sealed-spigot will bend downward. It will cause the fixed disc B of decoration to descend. Then, the out-in passage E between the top plane D of the sealed-spigot and the fixed disc B of decoration reduces, which is for suspended substance getting across after being disturbed. It seriously affects the smoothness of passage for suspended substance.

In view of that, the applicant with accumulating experience about designing and manufacturing dynamic landscape decoration for many years seeks the way to solve above problems. Through designing and developing real object, the invention, a fixed supporting structure of a crystal ball transmission, has been completed.

SUMMARY OF INVENTION

The main object of the invention is to provide a fixed supporting structure of a crystal ball transmission characterized in that the rubber sealed-spigot is designed to have a circular sealed-spigot body for sealing the opening of the crystal ball and a disc-shaped elastic buffer body, wherein, the buffer body further comprises an upper section planar disc edge, a middle section inclined disc edge and a lower section planar disc bottom; and by means of pushing upward a cup-shaped supporting body and stopping at the buffer body so as to form selected point supporting; when heat expansion and cold contraction are happened due to temperature difference of liquid within the crystal ball, the middle section inclined disc edge will stretch elastically and automatically to absorb the change of volume, by using the upward supporting force of the cup-shaped supporting body under the buffer body to ensure the horizontal position of the fixed disc of decoration unchanged, so as to further ensure the decoration would not incline for buffer body deformation due to the change of liquid volume.

Another object of the invention is to provide a fixed supporting structure of crystal ball transmission characterized in that the deformation of rubber sealed-spigot created by heat expansion and cold contraction due to temperature difference is absorbed completely by means of the maximum area provided by the middle section inclined disc edge of the buffer body.

The further object of the invention is to provide a fixed supporting structure of crystal ball transmission characterized in that by means of pushing upward a cup-shaped supporting body and stopping at the buffer body so as to form supporting effect. When heat expansion and cold contraction due to temperature difference causes the deformation of rubber sealed-spigot, the horizontal position of the fixed disc of decoration can be kept unchanged, so as to ensure the decoration not to incline, and after suspended substance disturbed to maintain the flowing out-in passage being smooth.

DETAILED DESCRIPTIONS OF EMBODIMENTS

The embodiment of the invention will be described below in conjunction with the drawings; the structural feature, function and object could be further understood with the help of the following figures and description.

Figure 1:
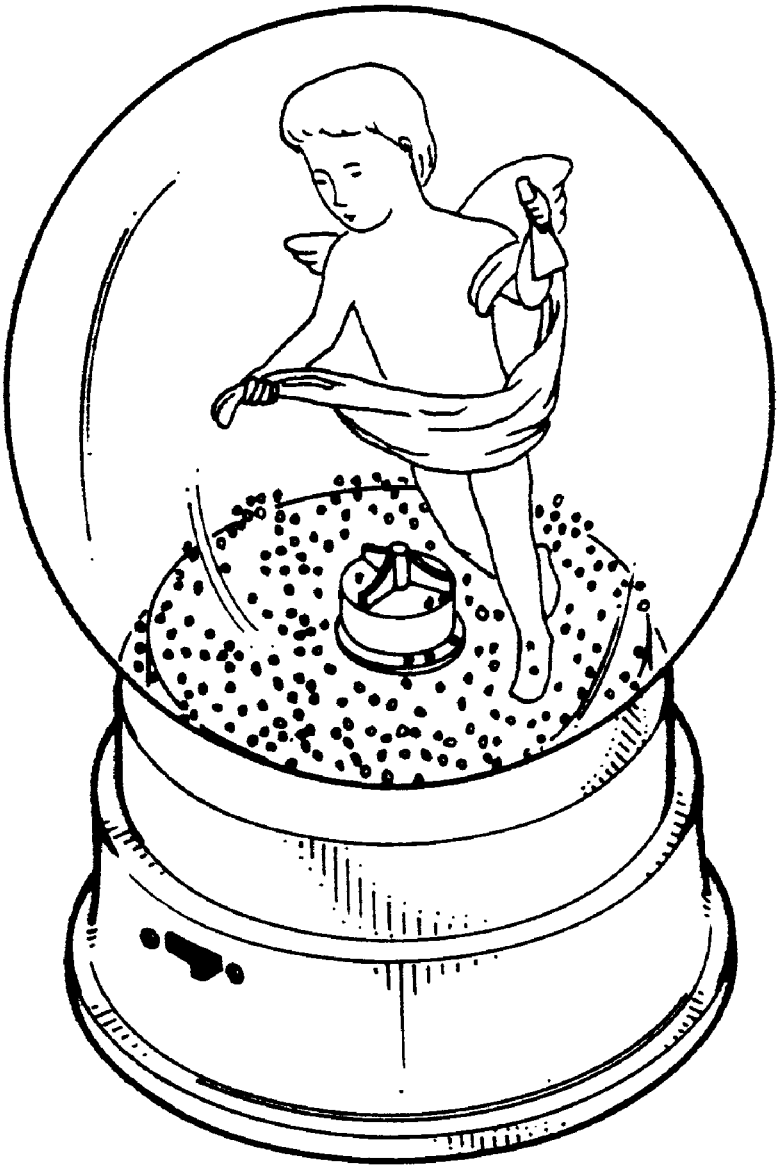
Fig. 1 Prior Art
FIG. 1 is an appearance perspective view of U.S. Pat. No. 4,961,276.
Figure 2:
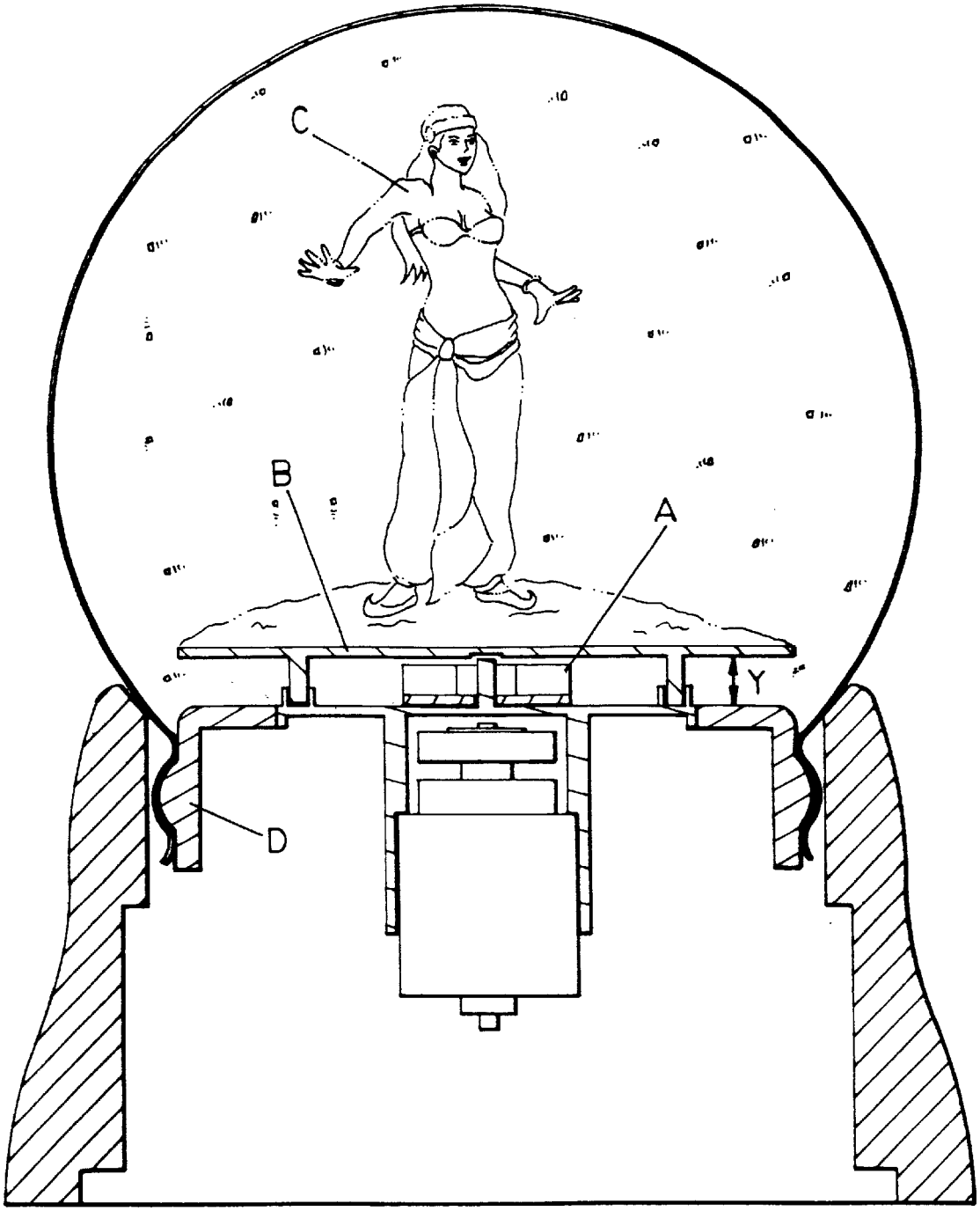
Fig. 2 Prior Art
FIG. 2 is a structural section view of a conventional crystal ball in normal temperature.
Figure 3:
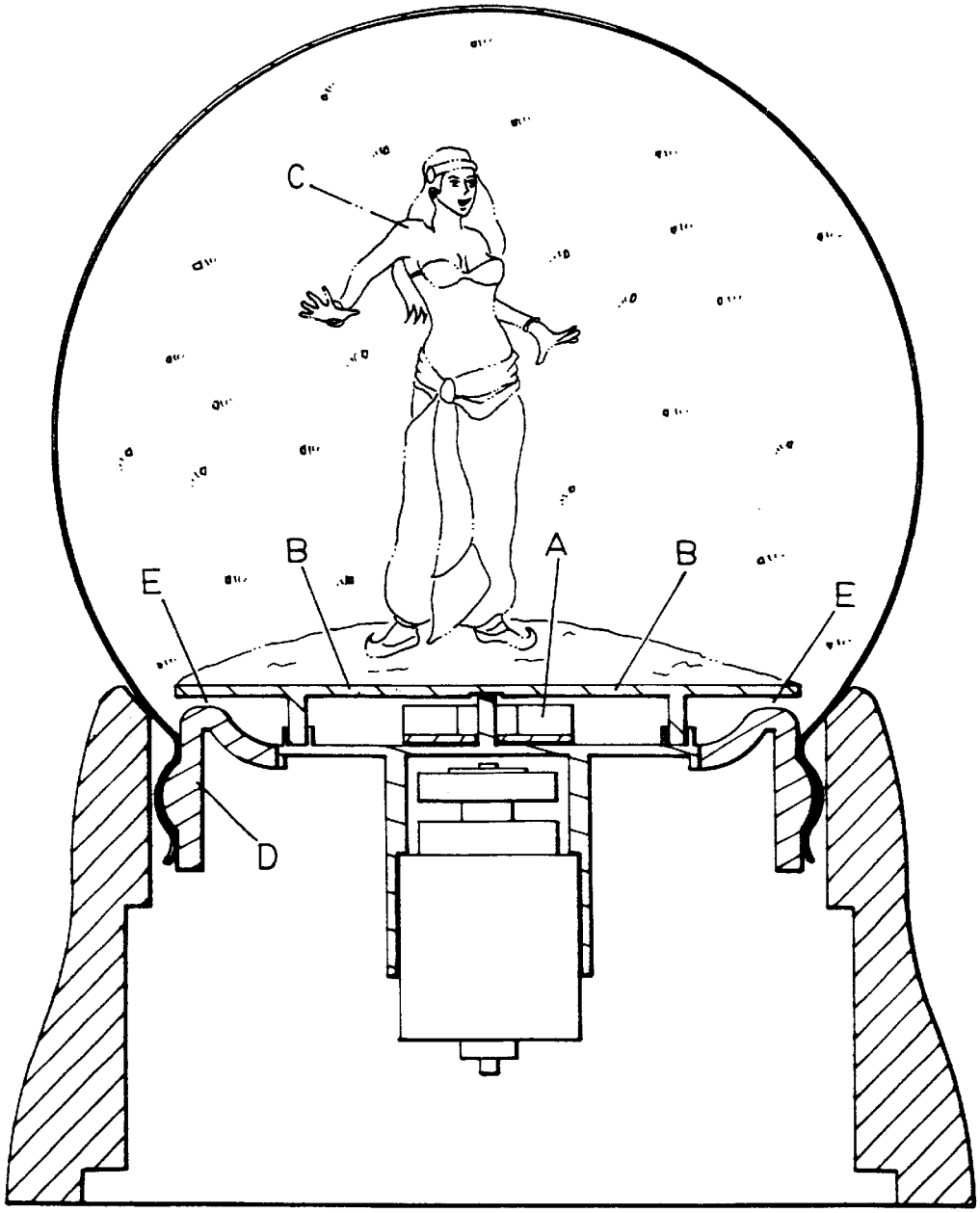
Fig. 3 Prior Art
FIG. 3 is a structural section view of a conventional crystal ball after liquid expansion.
Figure 4:
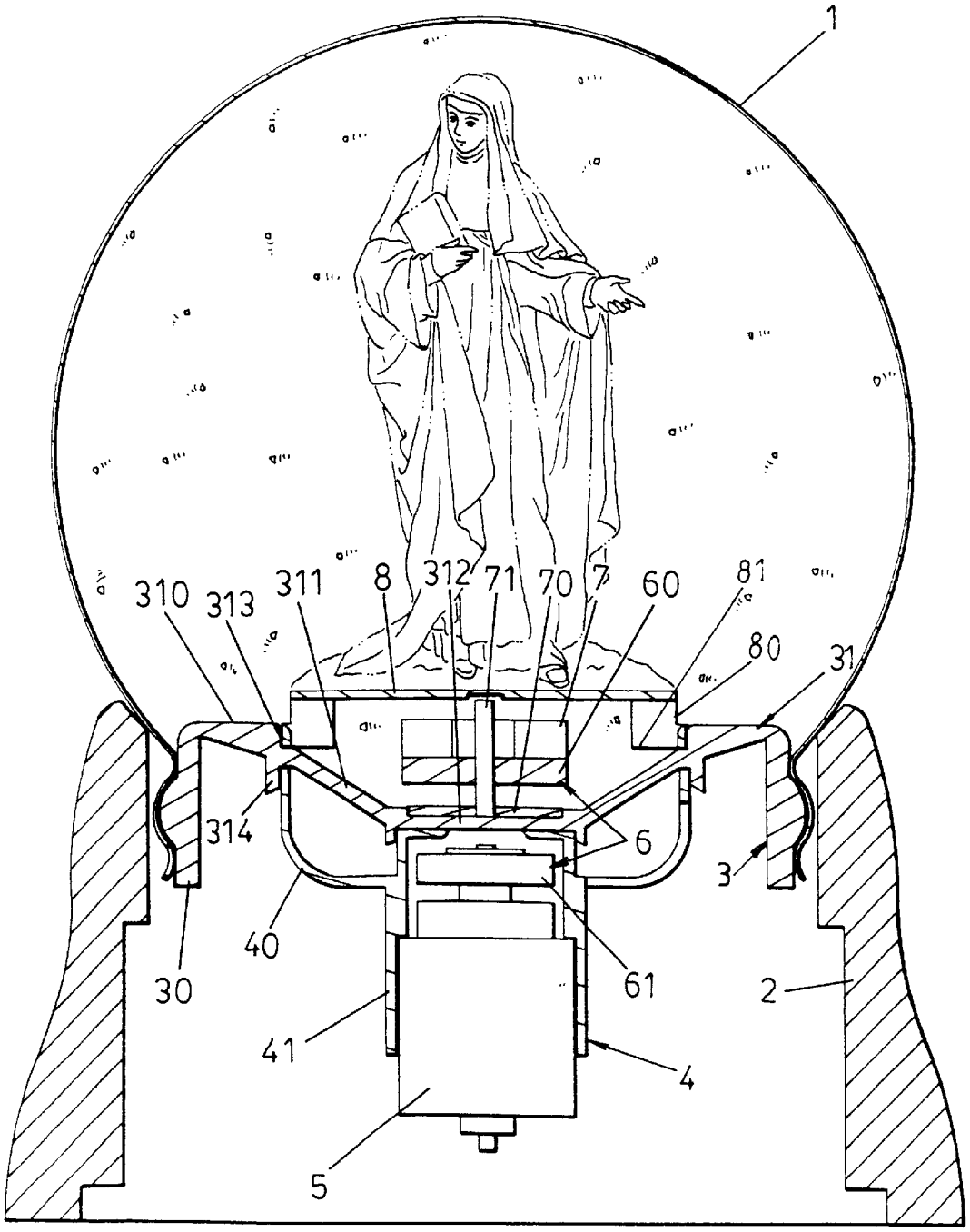
FIG. 4 is a structural section view of the invention.

See the section view of the invention shown in FIG. 4, the invention comprises crystal ball 1, base 2, soft rubber sealed-spigot 3, fixed seat 4 and driven motor 5, magnet set 6, disturbing vane 7, and fixed disc 8 of decoration and so on installed on above rubber sealed-spigot 3 and fixed seat 4.

Wherein, crystal ball 1 at its opening is sheathed in the top end of the base 2. Then, fill said crystal ball with liquid; finally, press said rubber sealed-spigot to plug into the opening of said crystal ball for sealing so as to ensure no leakage of liquid, As shown in the figure, the above rubber sealed-spigot 3 comprises circular sealed-spigot body 30 used for sealing the opening of the crystal ball and disc-shaped elastic buffer body 31. Wherein, the buffer body 31 further comprises upper section planar disc edge 310, middle section inclined disc edge 311 and lower section plane bottom3l2; the planar disc edge 310 and top plane at transition of inclined disc edge 311 form a groove seat 313 which can be used to adhere circular stake-leg 81 of fretwork 80 beneath fixed disc 8 of decoration; the planar disc edge 310 and bottom plane at transition of inclined disc edge 311 form a buckle 314 which can be used to combine with cup-shaped supporting body of later fixed seat 4; the planar disc bottom 312 of elastic buffer body 31 carries the base 70 fixed on the disc bottom, central shaft 71 fixed on the base 70 and both second magnet 60 and disturbing vane 7 fixed on central shaft which can rotate freely.

The above fixed seat 4 comprises a cup-shaped supporting body 40 and a tube-shaped shell 41, wherein, the cup-shaped supporting body 40 pushing upward and stopping at the planar disc edge of the buffer body 31 and the bottom plane at transition of the inclined disc edge 311 form a buckle 314, and have a selected point supporting effect to the transition; the upper edge of tube-shaped shell 41 of fixed seat 4 is adhered to the bottom of planar disc bottom 312 of buffer body 31, within shell 41 provided with driven motor 5 and first magnet 61.

When driven motor 5 drives first magnet 61 to rotate, both second magnet 60 and disturbing vane 7 installed above planar disc bottom 312 of buffer body 31 rotate together with the first magnet 61 with central shaft 71 as axis. The rotating disturbing vane 7 will disturb liquid continuously, after being disturbed the suspended substance flows out following the liquid from fretwork 80 of circular stake-leg 81 beneath fixed disc of decoration, and forms dynamic effect like snowing.

Figure 5:
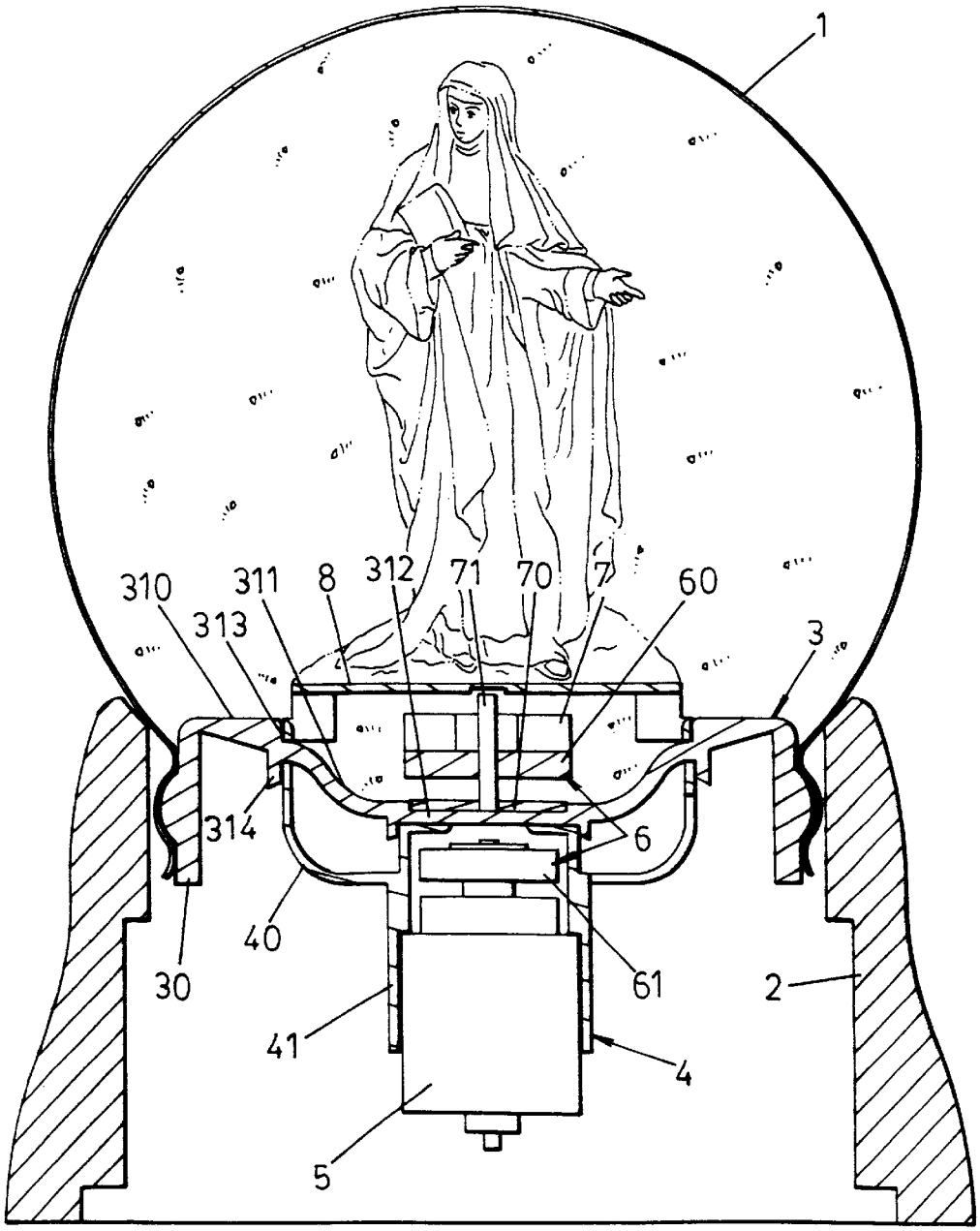
FIG. 5 is an embodiment of the invention.

See FIG. 5. When the volume of the liquid in crystal ball changes due to temperature difference, the middle section inclined disc edge 311 of the above buffer body 31 will stretch downward elastically and automatically, the maximum buffer area is expected to completely make up insufficient space after the expansion of liquid volume. Since under the buffer body 31 there is a supporting force pushing upward from cup-shaped supporting body 40, the position of the groove seat 313 used for adhering fretwork 80 and the circular steak-leg 81 beneath fixed disc 8 of decoration will maintain unchanged, so as to ensure the decoration not to incline due to deformation of buffer body caused by variance of liquid volume. Moreover, since the position of groove seat 313 of fixed disc 8 of decoration maintains unchanged, and may not displace up and down following the variance of liquid volume, the event that inlet and outlet of suspended substance are blocked at fretwork 80 of circular steak-leg beneath fixed disc 8 due to fixed disc of decoration lowering down may not happen.

As mentioned above, elastic stretching of the disc-shaped buffer body makes up the insufficient space caused by volume expansion of liquid due to temperature difference effectively. Meanwhile, selected point supporting of the cup-shaped supporting body to the buffer body, causes the position of fixed disc of decoration to maintain unchanged when the buffer body stretches elastically. And the event that inclining or blocking inlet and outlet of suspended substance may not happen. A patent is hereby filed in accordance with the Law. It is respectfully solicited that a patent be granted thereto.

What is claimed is:

1. A fixed supporting structure for a crystal ball transmission, comprising a crystal ball, a base, a soft rubber sealed-spigot, a fixed seat and a driven motor, a magnet set including a first magnet and a second magnet, a disturbing vane and a fixed disc of decoration installed on said rubber sealed-spigot and said fixed seat; wherein, said crystal ball has an opening engaging and sealed to a top end of said base by adhesive and said crystal ball filled with liquid; and said rubber sealed-spigot pressed into the opening of said crystal ball to ensure no leakage of liquid, and a suspended substance dispersed in said liquid in said crystal ball and wherein:

said rubber sealed-spigot, comprising a circular sealed-spigot body used for sealing the opening of said crystal ball and a disc-shaped elastic buffer body, wherein, said buffer body further comprising an upper section planar disc edge, a middle section, an inclined disc edge and a lower section planar disc bottom; said planar disc edge and said inclined disc edge at transition forming a groove seat, which is used for adhering a circular stake-leg of fretwork beneath said fixed disc of decoration; said planar disc edge and the planar disc bottom of said inclined disc edge at transition form a buckle, for combining the cup-shaped supporting body of said fixed seat; the planar disc bottom of said elastic buffer body carries said base fixed on said disc bottom, a central shaft fixed on said base and both second magnet and disturbing vane fixed on said central shaft to rotate freely; and said fixed seat comprising a cup-shaped supporting body and a tube-shaped shell, wherein, said cup-shaped supporting body pushes upward against said buckle formed by said planar disc edge of said buffer body together with the bottom plane of said inclined disc edge at transition, and having a supporting effect on said transition; the upper edge of said tube-shaped shell of said fixed seat is bonded to the bottom of said planar disc bottom of said buffer body, and within said shell provided with said driven motor and said first magnet.

* * * * *